US008064786B2

(12) United States Patent
Yamada

(10) Patent No.: US 8,064,786 B2
(45) Date of Patent: Nov. 22, 2011

(54) IMAGE FORMING APPARATUS

(75) Inventor: Toshiyuki Yamada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 543 days.

(21) Appl. No.: 12/274,326

(22) Filed: Nov. 19, 2008

(65) Prior Publication Data

US 2009/0136270 A1 May 28, 2009

(30) Foreign Application Priority Data

Nov. 22, 2007 (JP) ..... 2007-303597

(51) Int. Cl.
*G03G 15/16* (2006.01)
*G03G 15/00* (2006.01)
*G03G 15/01* (2006.01)

(52) U.S. Cl. ..... 399/66; 399/71; 399/297; 399/302; 399/306; 399/308

(58) Field of Classification Search ..... 399/66, 399/71, 121, 297, 302, 306, 308
See application file for complete search history.

(56) References Cited

U.S. PATENT DOCUMENTS

| | | | | |
|---|---|---|---|---|
| 4,984,026 | A * | 1/1991 | Nishise et al. | 399/302 |
| 6,427,062 | B1 * | 7/2002 | Takeuchi | 399/388 |
| 6,990,309 | B2 * | 1/2006 | Kayahara et al. | 399/302 |
| 7,043,183 | B2 * | 5/2006 | Yoda et al. | 399/302 |
| 7,590,375 | B2 * | 9/2009 | Iwata | 399/302 |
| 7,630,658 | B2 * | 12/2009 | Nishikawa | 399/49 |
| 7,773,902 | B2 * | 8/2010 | Takayanagi | 399/66 |
| 2004/0156657 | A1 * | 8/2004 | Takeuchi et al. | 399/302 |
| 2007/0196143 | A1 * | 8/2007 | Kaiho | 399/302 |
| 2008/0118281 | A1 * | 5/2008 | Saeki et al. | 399/308 |

FOREIGN PATENT DOCUMENTS

| | | | |
|---|---|---|---|
| JP | 10026890 | A * | 1/1998 |
| JP | 10301401 | A * | 11/1998 |
| JP | 2001-265095 | | 9/2001 |
| JP | 2002072615 | A * | 3/2002 |

* cited by examiner

*Primary Examiner* — David Gray
*Assistant Examiner* — Francis Gray
(74) *Attorney, Agent, or Firm* — Canon USA Inc IP Division

(57) ABSTRACT

An image forming apparatus is configured to select one of electrically discharging of an intermediate transfer member carried out by applying a voltage to a primary transfer member and electrically discharging of the intermediate transfer member carried out by applying a voltage to a secondary transfer member according to a charged state of the intermediate transfer member after secondary transfer.

6 Claims, 12 Drawing Sheets

CONTINUOUS IMAGE FORMATION

IMAGE FORMING APPARATUS

BACKGROUND OF THE INVENTION

1. Field of the Invention

The present invention relates to an image forming apparatus for secondary-transferring a toner image, which is primary-transferred from an image bearing member to an intermediate transfer member at a primary transfer portion, to a recording material at a secondary transfer portion, and more particularly to a electrically discharging mechanism for an intermediate transfer member, which is necessary when continuous image formation is performed.

2. Description of the Related Art

An image forming apparatus has been in practical use, which forms a full-color image by using a highly resistant (and insulative) intermediate transfer member left in a charged state after one rotation thereof in which an image is formed. The highly resistant intermediate transfer member has a high capability to hold electric charge given during transfer, which suppresses a toner scattering phenomenon that disturbs a transferred toner image.

However, repeated image formation by such a image forming apparatus causes charge-up where the charging potential of the intermediate transfer member gradually increases. Consequently, in order to transfer the toner image, a primary transfer voltage applied to a primary transfer member by a primary transfer power source and a secondary transfer voltage applied to a secondary transfer member by a secondary transfer power source need to be increased.

Accordingly, in the conventional image forming apparatus that uses the highly resistant intermediate transfer member, various electrically discharging apparatuses have been disposed between a secondary transfer portion and a primary transfer portion to prevent the intermediate transfer member from being charged up.

Japanese Patent Application Laid-Open No. 2001-265095 discusses a full-color image forming apparatus of a tandem intermediate transfer system which includes a plurality of photosensitive drums (image bearing members) in a linear section of an intermediate transfer belt. This image forming apparatus includes a electrically discharging apparatus on a downstream side of a secondary transfer portion, and a electrically discharging member of the electrically discharging apparatus, which is in contact with the intermediate transfer belt, is applied a voltage in which a DC voltage and AC voltage are superposed. However, in the image forming apparatus discussed in Japanese Patent Application Laid-Open No. 2001-265095, the electrically discharging apparatus is an obstacle for downsizing the image forming apparatus.

SUMMARY OF THE INVENTION

The present invention is directed to an image forming apparatus which can suppress charge-up of an intermediate transfer member without adding any electrically discharging apparatus dedicated to electrically discharging of the intermediate transfer member after secondary transfer. The present invention is also directed to an image forming apparatus that can electrically discharge an intermediate transfer member with a small number of components.

According to an aspect of the present invention, an image forming apparatus includes an image bearing member, an intermediate transfer member configured to bear a toner image transferred from the image bearing member, a primary transfer member configured to primary-transfer the toner image on the image bearing member to the intermediate transfer member, a first voltage application unit configured to apply to the primary transfer member a predetermined voltage of a first polarity for transferring the toner image on the image bearing member to the intermediate transfer member, a secondary transfer member configured to transfer the toner image on the intermediate transfer member to a recording material, a second voltage application unit configured to apply to the secondary transfer member a predetermined voltage of a second polarity for transferring the toner image on the intermediate transfer material to the recording material, an execution unit configured to execute a first discharging process of electrically discharging the intermediate transfer member by applying the voltage of the first polarity from the first voltage application unit to the primary transfer member, and a second discharging process of electrically discharging the intermediate transfer member by applying the voltage of the second polarity from the second voltage application unit to the secondary transfer member, and a selection unit configured to select a discharging process according to a charged state of the intermediate transfer member after secondary transfer.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

The present invention can be implemented by other embodiments which replace some or all components of the exemplary embodiments with alternative components as long as primary and secondary transfer portions are complementarily used to electrically discharge an intermediate transfer member.

Thus, the invention can be implemented by image forming apparatuses including not only a tandem intermediate transfer system, which includes a plurality of sets of image bearing members and primary transfer members disposed along the intermediate transfer portion, but also a one-drum intermediate transfer system, which includes one photosensitive drum.

In the exemplary embodiment, only a main section regarding formation/transfer of a toner image will be described. Note, however, that the present invention can be implemented in various apparatuses, such as a printer, various printing machines, a copying machine, a facsimile machine, and a multifunction peripheral, by adding necessary devices, equipments, and a casing structure.

General items of the image forming apparatus discussed in Japanese Patent Application Laid-Open No. 2001-265095 are not illustrated, nor any descriptions thereof will be repeated.

Figure 1:
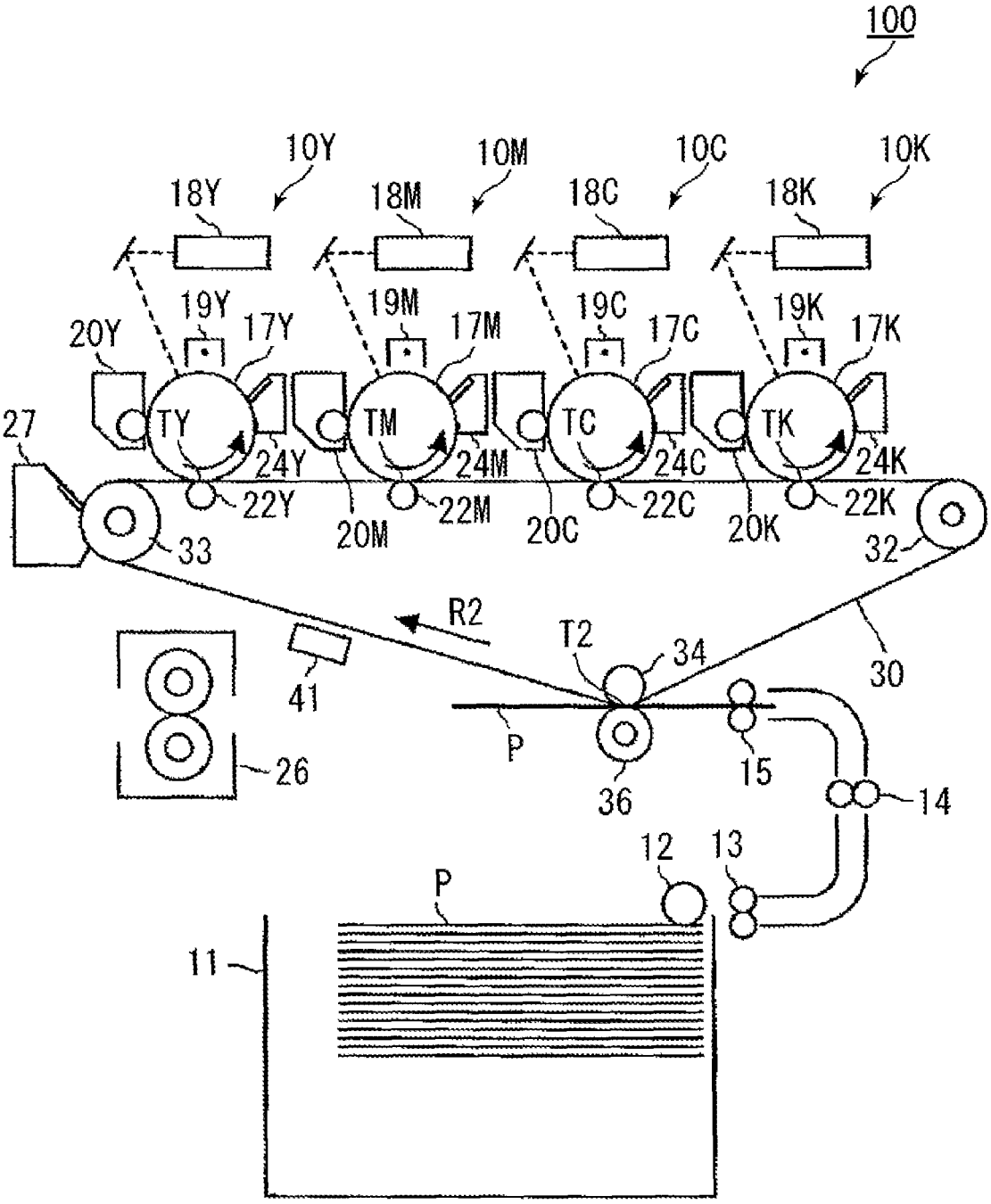
FIG. 1 illustrates a configuration of an image forming apparatus according to a first exemplary embodiment of the present invention.
Figure 2:
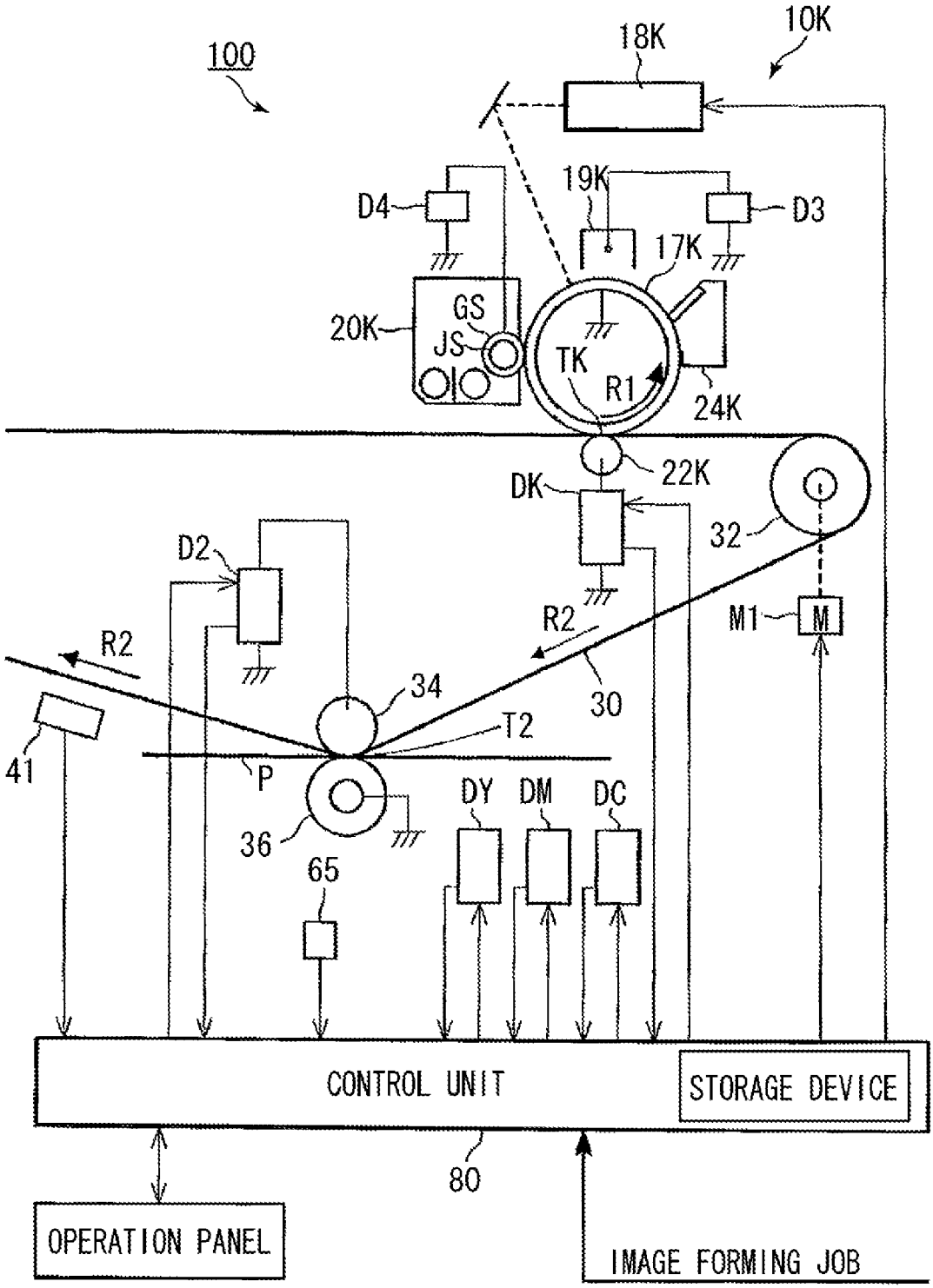
FIG. 2 illustrates a configuration of primary and secondary transfer portions of the image forming apparatus.

FIG. 1 illustrates a configuration of an image forming apparatus according to a first exemplary embodiment of the present invention. FIG. 2 illustrates a configuration of primary and secondary transfer portions of the image forming apparatus.

As illustrated in FIG. 1, the image forming apparatus 100 of the first exemplary embodiment is a tandem full-color laser beam printer which includes image forming units 10Y, 10M, 10C, and 10K respectively for yellow, magenta, cyan, and black disposed along an intermediate transfer belt 30. The image forming apparatus 100 is an example of an image forming apparatus that includes a plurality of sets of image bearing members and primary transfer members disposed along an intermediate transfer member.

The image forming unit 10Y forms a yellow toner image on a photosensitive drum 17Y to primary-transfer it to the intermediate transfer belt 30. The image forming unit 10M forms a magenta toner image on a photosensitive drum 17M, and superimposes the magenta toner image on the yellow toner image to primary-transfer it to the intermediate transfer belt 30. The image forming units 10C and 10K respectively form a cyan toner image and a black toner image on photosensitive drums 17C and 17K, and similarly superimpose them respectively on the magenta toner image to primary-transfer them to the intermediate transfer belt 30.

The toner image made of four colors borne on the intermediate transfer belt 30 is conveyed to a secondary transfer portion T2 to be secondary-transferred collectively to recording materials P. The recording materials P are pulled out from a feed cassette 11 by a feed roller 12, separated one by one by a separator 13, and sent to a registration roller 15 by a conveying roller 14.

The registration roller 15 aligns a head of the recording material P with the toner image on the intermediate transfer belt 30 to continuously feed the recording materials P to the secondary transfer portion T2 at short intervals described below.

The recording material P, on which the toner image made of four colors is secondary-transferred, is sent to a fixing device 26, and heated and pressurized to fix full-color images on its surface.

An intermediate transfer belt cleaning device 27 removes transfer residual toner left on the intermediate transfer belt 30 after the intermediate transfer belt 30 passes through the secondary transfer portion T2.

The image forming units 10Y, 10M, 10C, and 10K are similarly configured except a difference in toner colors, such as yellow, magenta, cyan, and black. Consequently, only the black image forming unit 10K will be described below, and K will be replaced by Y, M and C to respectively describe the image forming units 10Y, 10M, and 10C. In addition, for example, a charging device 19K is similarly configured to charging devices 19C, 19M, and 19Y, and a cleaning device 24K is similarly configured to cleaning devices 24C, 24M, and 24Y, which are described below.

As illustrated in FIG. 2, the image forming unit 10K includes a charging device 19K, an exposure device 18K, the developing device 20K, a primary transfer roller 22K, and a cleaning device 24K, which are disposed around the photosensitive drum 17K.

The photosensitive drum 17K (an exemplary image bearing member) is configured by coating an organic photo conductor (OPC) layer of negative charge polarity on an outer peripheral surface of an aluminum cylinder. The photosensitive drum 17K is rotated in an arrow direction R1 by a driving force from a driving motor M1.

The charging device 19K is applied a negative voltage from a power source D3, and irradiates charged particles on the surface of the photosensitive drum 17K to charge it to a uniform potential of negative polarity.

The exposure device 18K scans scanning line image data, which is a rasterized black color image, with an on-off modulated laser beam by a rotary mirror to write an electrostatic image on the charged surface of the photosensitive drum 17K with a resolution of 600 dots/inch (dpi).

The developing device 20K stirs a two-component developer containing a magnetic carrier mixed with toner to charge the toner to negative polarity. The charged toner is borne by the photosensitive drum 17K and a developing sleeve GS, which rotates in the counter direction thereto, in a napped state around a fixed pole JS to slide and to rub the photosensitive drum 17K.

A power source D4 applies a developing voltage, generated by superimposing an AC voltage on a negative polarity DC voltage, to the developing sleeve GS. Then, toner is attached to an electrostatic image on the photosensitive drum 17K, which is more positive in polarity relative to the developing sleeve GS to inversely develop the electrostatic image.

The primary transfer roller 22K holds the intermediate transfer belt 30 with the photosensitive drum 17K to form a primary transfer portion TK between the photosensitive drum 17K and the intermediate transfer belt 30.

A primary transfer power source DK applies a primary transfer voltage (DC voltage) of positive polarity to the primary transfer roller 22K. Thereby, the toner image, charged to negative polarity and borne on the photosensitive drum 17K, is primary-transferred to the intermediate transfer belt 30 that passes through the primary transfer portion TK.

The cleaning device 24K slides and rubs a cleaning blade on the photosensitive drum 17K to remove transfer residual toner that has been left on the surface of the photosensitive drum 17K after passing through the primary transfer portion TK.

A secondary transfer roller 36 is pressed to contact a backup roller 34 via the intermediate transfer belt 30, thereby forming a secondary transfer portion T2 between the intermediate transfer belt 30 and the secondary transfer roller 36.

The secondary transfer portion T2 holds and conveys a recording material P, which is superimposed on the toner image of the intermediate transfer belt 30, and secondary-transfers the toner image from the intermediate transfer belt 30 to the recording material P while the recording material P is passing through the secondary transfer portion T2.

A secondary transfer power source D2 applies a secondary transfer voltage (DC voltage) of negative polarity to the backup roller 34 to supply a transfer current to a series circuit including the backup roller 34, the intermediate transfer belt 30, the recording material P, and the secondary transfer roller 36. A part of the transfer current flows through a toner bearing portion of the intermediate transfer belt 30 to transfer the toner from the intermediate transfer belt 30 to the recording material P.

Figure 7:
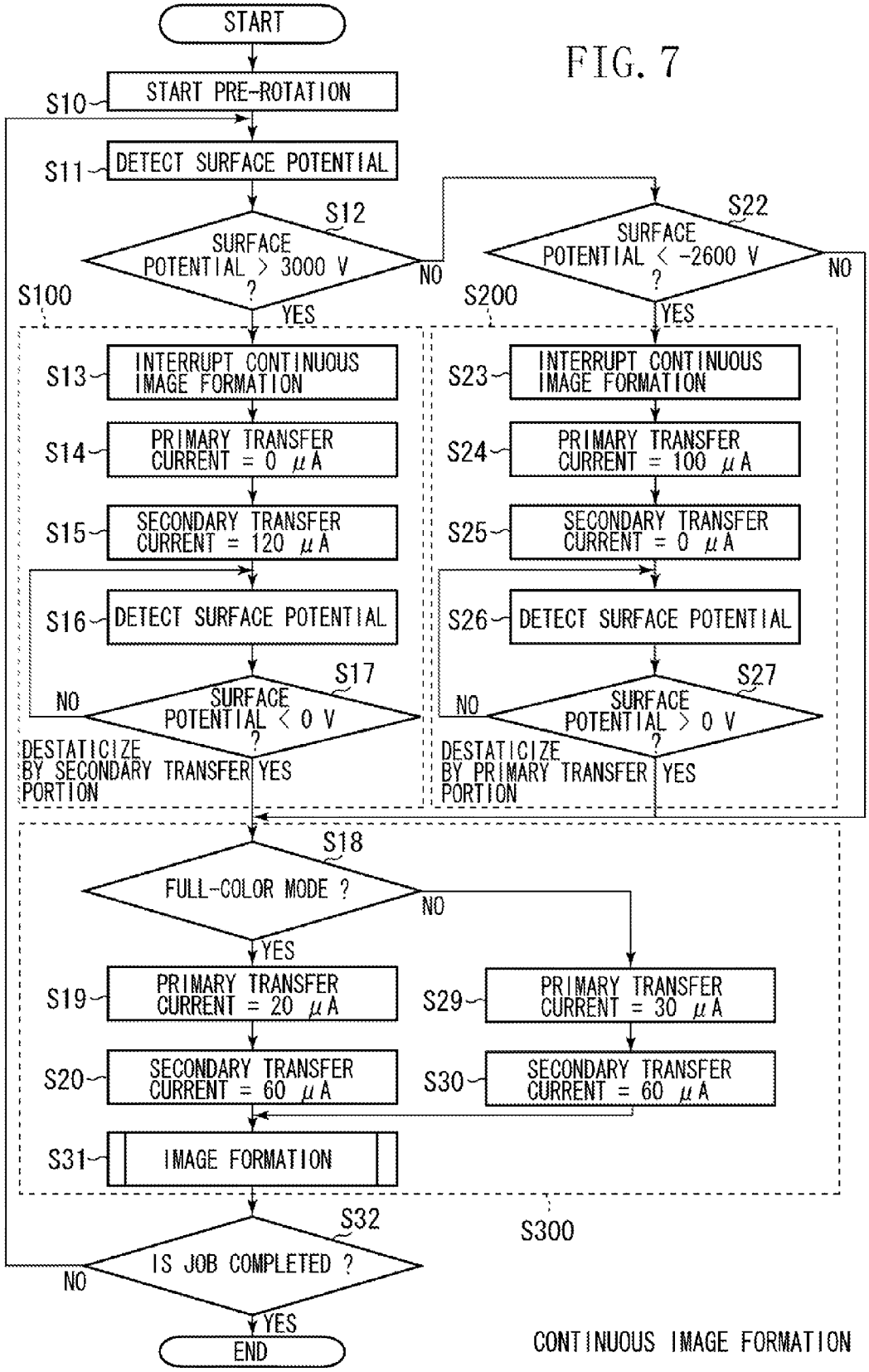
FIG. 7 is a flowchart of electrically discharging control according to the first exemplary embodiment.

A control unit 80 is a microcomputer control device that executes a program flow illustrated in FIG. 7.

As illustrated in FIG. 1, the intermediate transfer belt 30, which is an exemplary intermediate transfer member, is supported along a driving roller 32, a tension roller 33, and the backup roller 34. The intermediate transfer belt 30 bears four A4-crossfeed toner images per round at intervals of 30 mm (inter-paper distance) during continuous image formation. The toner image bearing distance is adjusted so that the intermediate transfer belt 30 makes almost one rotation with four images.

As illustrated in FIG. 2, the intermediate transfer belt 30 is driven by the driving motor M1 to rotate in an arrow direction R2. The intermediate transfer belt 30 is made of a highly resistant resin film material containing an appropriate amount of antistatic agents, such as carbon black, in a polyimide resin single layer. However, other materials, such as a resin, e.g., an acrylic based resin or a polyester based resin, or various types of rubber can be used.

The intermediate transfer belt 30 used herein has a thickness of 85 μm and a peripheral length of 850 mm. A surface resistivity is adjusted to $10^{14}$ to $10^{15}$ Ω/sq (ohms per square), and a volume resistivity is adjusted to $10^{13}$ to $10^{14}$ Ω·cm (ohms per centimeter of thickness).

Generally, a semiconductor film material is used for an intermediate transfer member. A material having a volume resistivity of $10^{8}$ to $10^{12}$ Ω·cm is often used. Such a conventional mid-resistant intermediate transfer member allows easy movement of charges in a thickness direction of the intermediate transfer member. Even if the intermediate transfer member holds charges immediately after a transfer process from an image bearing member to the intermediate transfer member or a transfer process from the intermediate transfer member to a recording material, when the intermediate transfer member is supported by a rotary member connected to a ground potential to rotate once, a charged state of the intermediate transfer member is almost eliminated.

However, when a process speed is high, or when a semiconductor film material is highly resistant (insulative), a charged state is maintained even after one rotation, and continuous image formation gradually increases a charge potential.

When continuous image formation is carried out by using an extremely high-resistance intermediate transfer member having a surface resistivity of $1\times10^{13}$ Ω/sq or more and/or a volume resistivity of $1\times10^{13}$ Ω·cm or more, the surface potential of the intermediate transfer member is increased considerably.

When a transfer process is carried out in an insufficiently discharged state of the intermediate transfer member, electric charges charged on the intermediate transfer member may cause a transfer failure, a change in color, or color misregistration.

In order to obtain a high-quality stable image, it is necessary to mount a electrically discharging discharger (e.g., colotron charger) to remove charging history charged during a previous process of the intermediate transfer member before a next transfer process.

Use of the colotron charger for discharging requires a large power source or a high-voltage-resistant insulating material, because a power supply voltage for applying a electrically discharging bias is high, for example, several kV. A space for installing a colotron charger also is needed. Electrically discharging using the colotron charger needs ozone generation countermeasures. Thus, the colotron charger is disadvantageous in terms of cost, an environmental problem, and mounting.

When the intermediate transfer member moves between a conductive roller member and a brush member, an AC electric field can be applied to the roller member or the brush member to electrically discharge the intermediate transfer member. This is a technology of applying an AC electric field to the intermediate transfer member and reducing a charging amount while a charged portion of the intermediate transfer member moves away from the AC electric field portion.

However, use of the AC electric field for electrically discharging needs an AC power source and dedicated members. To improve electrically discharging effects, the intermediate transfer member needs a specific curvature, thus causing an increase in size and cost of the image forming apparatus. When downsizing of the image forming apparatus is necessary, mounting of the dedicated electrically discharging members in a limited space makes designing difficult.

A bias voltage of a polarity opposite the polarity of a voltage applied during image formation can be applied to the secondary transfer member to electrically discharge the intermediate transfer member.

However, when electrically discharging is performed using a bias voltage of single polarity, if it is not known whether the surface potential of the intermediate transfer member is in a plus or minus state after the completion of the transfer process, the bias voltage may be difficult to apply.

For each of the primary transfer rollers 22Y, 22M, 22C, and 22K (an example of primary transfer members), an elastic layer of urethane rubber is formed on an outer periphery of an aluminum core metal, and the material of the elastic layer is mixed with an ion conductive material to adjust resistance to about $10^{7}$ Ω·cm. For a backup roller 34 (an example of secondary transfer member or back-up member), an elastic layer made of solid structure rubber material is formed on an outer periphery of an aluminum core metal. The rubber material is mixed with a particle structure electron conductive material to adjust resistance to about $10^{5}$ Ω·cm or less.

For the secondary transfer roller 36, an elastic layer made of a sponge structure rubber material is formed on an outer periphery of an aluminum core metal. The rubber material is mixed with a particle structure electron conductive material to adjust resistance to $10^{7}$ Ω·cm or less. The secondary transfer roller 36 is connected to the ground potential.

As illustrated in FIG. 1, a surface potential sensor 41 is disposed between the secondary transfer portion T2 and the primary transfer portion TY.

The surface potential sensor 41 detects a surface potential of the intermediate transfer belt 30 passed through the secondary transfer portion T2 to be in a floating state before reaching the primary transfer portion TY to output an analog voltage corresponding to the surface potential to the control unit 80.

The surface potential sensor 41 is disposed in a thrust area to which the transfer currents are applied by the primary transfer rollers 22Y, 22M, 22C, and 22K and the secondary transfer roller 36.

As illustrated in FIG. 2, each of the power sources DY, DM, DC, and DK controls a primary transfer voltage to be a constant current so that a detected primary transfer current becomes a predetermined current value suitable for obtaining high transfer performance. As described below, an example of a secondary transfer power source used for electrically discharging is a secondary transfer power source D2.

The control unit 80 determines primary transfer currents (primary constant currents) 1TrI according to an output of a temperature and humidity sensor 65 to set them in the power sources DY, DM, DC, and DK. According to the first exemplary embodiment, the primary transfer current 1TrI for each color is equal in value with each other, and it is set to be 20 μA in a direction from the intermediate transfer belt 30 to the photosensitive drums 17Y, 17M, 17C, and 17K.

The control unit 80 controls primary transfer voltages applied to the primary transfer rollers 22Y, 22M, 22C, and 22K by setting the constant currents. The control unit 80 outputs control signals to the power sources DY, DM, DC, and DK to control each output voltage to be a constant current. Thus, the primary transfer current 1TrI (20 μA) flows in the primary transfer rollers 22Y, 22M, 22C, and 22K according to the control signals.

An upper limit value of each primary transfer voltage, which is output from each of the power sources DY, DM, DC, and DK, is set to be 4500 V for suppressing the cost and size of a high-voltage power supply. The upper limit value is determined so that abnormal discharging would not occur in the creepage distance for insulation between the primary transfer rollers 22Y, 22M, 22C, and 22K and the members arranged therearound, or so that an image failure, such as color misregistration or a disturbed toner image, would not occur.

The secondary transfer power source D2 controls a secondary transfer voltage (output voltage) to perform constant current control so that the secondary transfer current becomes a prescribed current value suitable for a high transfer performance.

The control unit 80 determines a secondary transfer current (secondary constant current) 2TrI according to an output of a temperature humidity sensor 65 to set it to the secondary transfer power source D2. According to the first exemplary embodiment, total secondary transfer current for four colors 2TrI is set to be −60 μA, which flows in a direction from the intermediate transfer belt 30 to the secondary transfer roller 36 via the recording material.

The control unit 80 controls a secondary transfer voltage applied to the backup roller 34 by setting the constant current. The control unit 80 outputs a control signal to the secondary transfer power source D2 to control an output voltage to keep a constant current. Thus, a secondary transfer current 2TrI (−60 μA) flows in the backup roller 34 according to the control signal.

An upper limit value of a secondary transfer voltage output from the secondary transfer power source D2 is set to be −4500 V for suppressing the cost and size of a high-voltage power supply. The upper limit value is determined so that abnormal discharging would not occur in a creepage distance for insulation between the backup roller 34 and members disposed therearound, or so that density fluctuation caused by a transfer failure or an image failure such as a shock image would not occur.

According to the first exemplary embodiment, to suppress a potential increase of the intermediate transfer member surface, the polarities of the output voltages of the primary and secondary power source units are set to be opposite each other.

During primary transfer, a voltage of a polarity opposite the polarity of toner is applied to the primary transfer member to charge the intermediate transfer member to the polarity opposite the polarity of toner. During secondary transfer, a voltage of the same polarity as that of toner is applied to the secondary transfer member to charge the intermediate transfer member to the same polarity as that of toner.

Thus, the intermediate transfer member, when charged by the primary transfer member, is electrically discharged by the secondary transfer member, and the intermediate transfer member, when charged by the secondary transfer member, is electrically discharged by the primary transfer member. Consequently, a potential increase of the intermediate transfer member is complementarily suppressed while forming an image.

However, transfer voltages applied to the primary and secondary transfer members are independently set based on the primary transfer performance and the secondary transfer performance, respectively. Therefore, while the potential increase of the intermediate transfer member can be suppressed, when a large number of images are continuously formed, a charge potential of the intermediate transfer member rises to a polarity of one of the primary transfer voltage and the secondary transfer voltage. The rise in charged potential of the intermediate transfer member causes problems, such as a transfer failure, a change in color, or color misregistration.

The control unit 80 executes a full-color mode using the image forming units (10Y, 10M, 10C, and 10K illustrated in FIG. 1) to form a full-color image, and a black single color mode using the image forming unit 10K to perform primary transfer once, thereby forming a monochrome image.

In the full-color mode, which is an example of a color image forming mode, the method of forming an image by using a plurality of sets of image bearing members and primary transfer members is described above.

In the black single color mode, which is an example of a single color image forming mode, the number of times of performing primary transfer is different from that of the full-color mode. The image forming units 10Y, 10M, and 10C illustrated in FIG. 1 execute no image forming operations, so that the photosensitive drums 17Y, 17M, and 17C are in an idle running state. The exposure devices 18Y, 18M, and 18C, the charging devices 19Y, 19M, and 19C, the developing devices 20Y, 20M, and 20C, and the primary transfer rollers 22Y, 22M, and 22C execute no image forming operations.

In other words, an image is formed only by using one set of an image bearing member and a primary transfer member. A black toner image is formed on the photosensitive drum 17K by the exposure device 18K, the charging device 19K, and the developing device 20K, and primary-transferred to the intermediate transfer belt 30 by the primary transfer roller 22K. The black toner image primary-transferred to the intermediate transfer belt 30 is conveyed to the secondary transfer portion T2 to be secondary-transferred to a recording material P, and then fixed to be output as a black single-color image.

EXPERIMENT 1

FIGS. 3A to 3D illustrate changes of the voltages applied to the primary transfer roller in the full-color mode. FIGS. 4A and 4B illustrate changes of the surface potential of the intermediate transfer belt 30 in the full-color mode.

FIGS. 3A to 3D illustrate, when continuous image formation is performed on an A4 recording material in the full-color mode, changes of the primary transfer voltages output from the power sources DY, DM, DC, and DK to the primary transfer rollers 22Y, 22M, 22C, and 22K. FIG. 4A illustrates a change of the surface potential of the intermediate transfer belt 30 measured by a surface electrometer disposed in a position adjacent to the entrance of the secondary transfer portion T2. FIG. 4B illustrates a change of the surface potential of the intermediate transfer belt 30 measured by a surface electrometer disposed in a position adjacent to the exit of the secondary transfer portion T2.

Figure 3A:
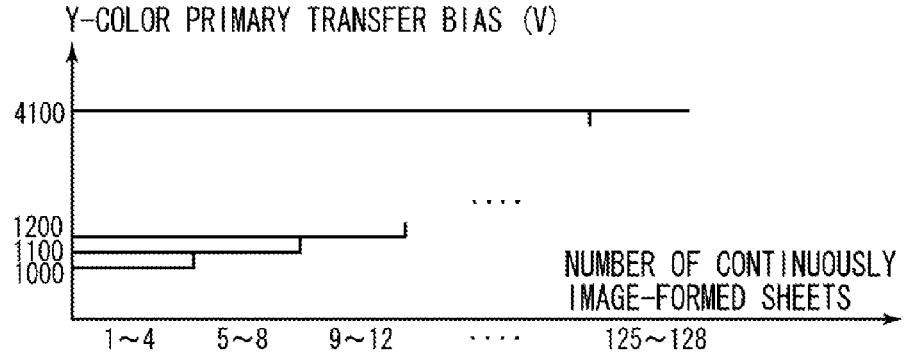
FIGS. 3A to 3D illustrate changes of a voltage applied to a primary transfer roller in a full-color mode.
Figure 4A:
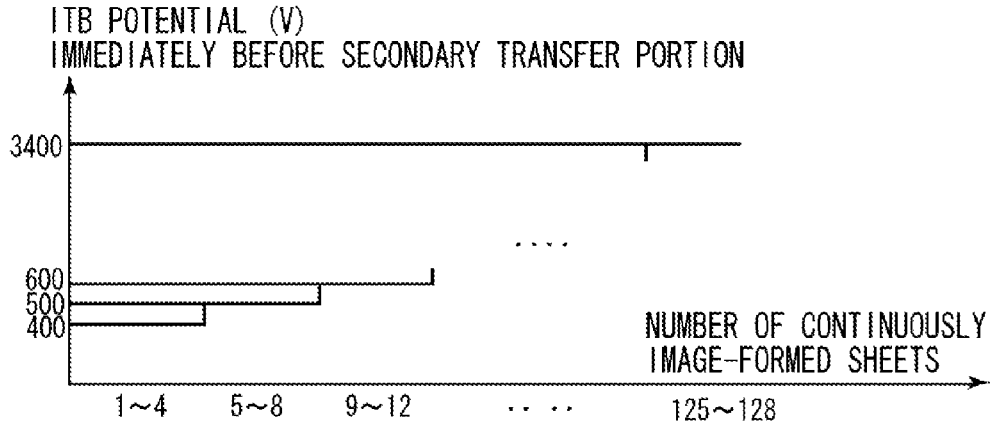
FIGS. 4A and 4B illustrate changes of a surface potential of an intermediate transfer belt in the full-color mode.
Figure 4B:
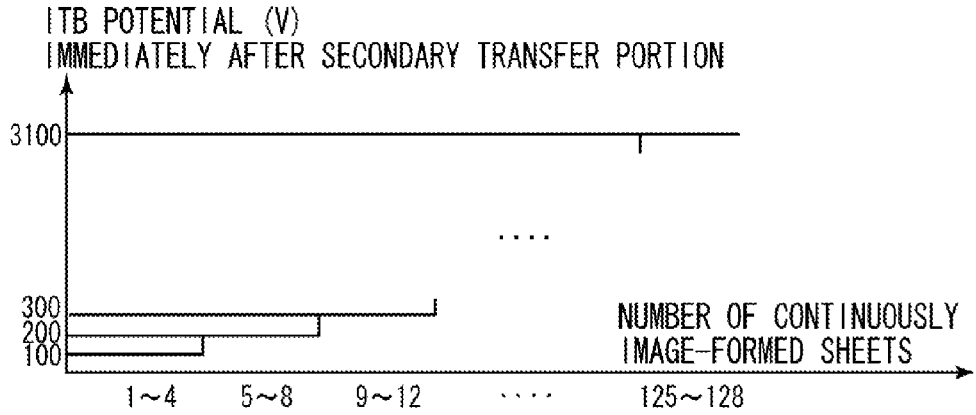

As illustrated in FIG. 3A, a primary transfer voltage applied to the primary transfer roller 22Y gradually increases by 100 V. For example, the voltage is at about 1000 V during the image formation of 1st to 4th sheets, at about 1100 V during the image formation of 5th to 8th sheets, and at about 1200 V during the image formation of 9th to 12th sheets.

Such a rise in primary transfer voltage is caused by the charge-up of the intermediate transfer belt 30 during its one rotation for every four recording materials, and its passage through the primary transfer portions TY, TM, TC, and TK and the secondary transfer portion T2.

Figure 3B:
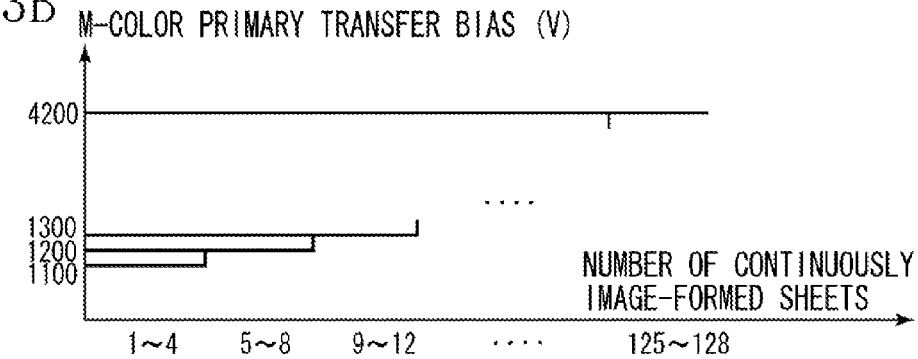

As illustrated in FIG. 3B, the primary transfer voltage applied to the primary transfer roller 22M gradually increases by 100 V. For example, the voltage is at about 1100 V during the image formation of 1st to 4th sheets, at about 1200 V during the image formation of 5th to 8th sheets, and at about 1300 V during the image formation of 9th to 12th sheets.

Such a rise in primary transfer voltage is caused by the charge-up of the intermediate transfer belt 30 during its one rotation for every four recording materials, and its passage through the primary transfer portions TM, TC, and TK, the secondary transfer portion T2, and the primary transfer portion TY.

The primary transfer voltage at the 1st to 4th sheets is higher by 100 V than the voltage of about 1000 V at the 1st to 4th sheets illustrated in FIG. 3A. That is because 100 V is charged up on the intermediate transfer belt 30 during its passage through the primary transfer portion TY.

Figure 3C:
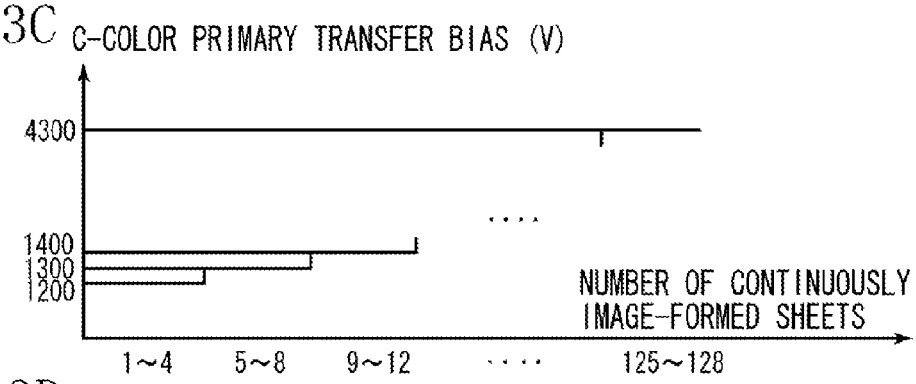

As illustrated in FIG. 3C, the primary transfer voltage applied to the primary transfer roller 22C gradually increases by 100 V. For example, the voltage is at about 1200 V during the image formation of 1st to 4th sheets, at about 1300 V during the image formation of 5th to 8th sheets, and at about 1400 V during the image formation of 9th to 12th sheets.

Such a rise in the primary transfer voltage is caused by the charge-up of the intermediate transfer belt 30 during its one rotation for every four recording materials, and its passage through the primary transfer portions TC and TK, the secondary transfer portion T2, and the primary transfer portions TY and TM.

The primary transfer voltage at the 1st to 4th sheets is higher by 100 V than the voltage of about 1100 V at the 1st to 4th sheets illustrated in FIG. 3B. That is because 100 V is charged up on the intermediate transfer belt 30 during its passage through the primary transfer portion TM.

Figure 3D:
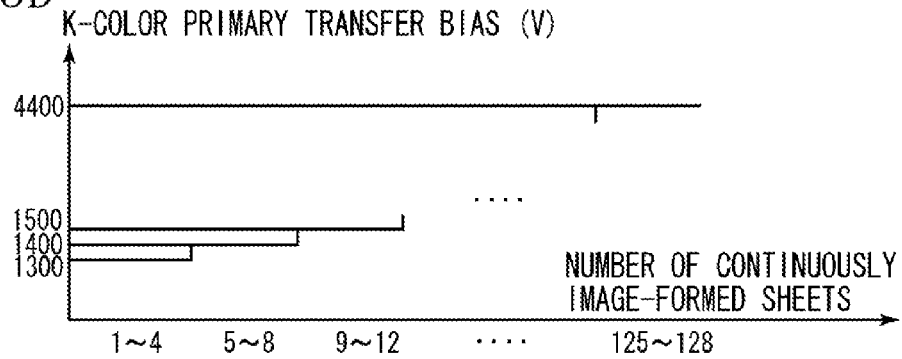

As illustrated in FIG. 3D, a primary transfer voltage applied to the primary transfer roller 22K gradually increases by 100 V. For example, the voltage is at about 1300 V during the image formation of 1st to 4th sheets, at about 1400 V during the image formation of 5th to 8th sheets, and at about 1500 V during the image formation of 9th to 12th sheets.

Such a rise in primary transfer voltage is caused by the charge-up of the intermediate transfer belt 30 during its one rotation for every four recording materials, and its passage through the primary transfer portion TK, the secondary transfer portion T2, and the primary transfer portions TY, TM, and TC.

The primary transfer voltage at the 1st to 4th sheets is higher by 100 V than the voltage of about 1200 V at the 1st to 4th sheets illustrated in FIG. 3C. That is because 100 V is charged up on the intermediate transfer belt 30 during its passage through the primary transfer portion TC.

As illustrated in FIG. 4A, a surface potential of the intermediate transfer belt 30 in a position immediately before entering the secondary transfer portion T2 is about 400 V during the image formation of 1st to 4th sheets. That is because the intermediate transfer belt 30 is brought into contact with the primary transfer rollers 22Y, 22M, 22C, and 22K to be charged to 400 V during its passage though the primary transfer portions TY, TM, TC, and TK.

As illustrated in FIG. 4B, a surface potential of the intermediate transfer belt 30 in a position immediately after passing through the secondary transfer portion T2 is about 100 V during the image formation of 1st to 4th sheets. That is because the intermediate transfer belt 30 is charged up by −300 V by the backup roller 34 during its passage through the secondary transfer portion T2, so that a residual potential becomes 100 V.

Thus, according to Experiment 1, when continuous image formation is carried out in an A4-size recording material in the full-color mode, the intermediate transfer belt 30 is charged up by 100 V for each rotation to increase the surface potential by 100 V.

As illustrated in FIG. 3A, when the continuous image formation is further continued, during the image formation of 125th to 128th sheets, the primary transfer voltage applied to the primary transfer roller 22Y increases to about 4100 V. As illustrated in FIGS. 3B to 3D, during the image formation of 125th to 128th sheets, the primary transfer voltages applied to the primary transfer rollers 22M, 22C, and 22K increase to about 4200 V, 4300 V, and 4400 V, respectively.

Thus, when the intermediate transfer belt 30 is rotated one round to form 129th to 132nd image sheets, a primary transfer voltage to be applied to the primary transfer roller 22K reaches an upper limit value of 4500 V. This situation may possibly occur after execution of the color image forming mode.

In this case, the power sources DY, DM, DC, and DK can no longer supply necessary primary transfer voltages due to a capacity inadequacy for a high-voltage power supply, thus increasing a possibility of the occurrence of an image failure, such as color fluctuation or color misregistration, caused by a transfer failure. In the primary transfer rollers 22Y, 22M, 22C, and 22K to which abnormal high voltages have been applied, a possibility of abnormal discharging to the members therearound or a current leakage phenomenon increases.

As illustrated in FIG. 4B, during the image formation of 125th to 128th sheets, a surface potential of the intermediate transfer belt 30 in a position immediately after passing through the secondary transfer portion T2 is about 3100 V.

Thus, according to the first exemplary embodiment, as illustrated in FIG. 2, the surface potential sensor 41 is disposed to detect the surface potential of the intermediate transfer belt 30. The control unit 80 interrupts the continuous image formation when a detection result by the surface potential sensor 41 exceeds a predetermined potential (3000 V) as a first voltage, and electrically discharges the intermediate transfer belt 30 by the secondary transfer portion T2. An absolute value of the predetermined potential is 3000 V. The surface potential of the intermediate transfer member has a polarity opposite that of a toner image. Thus, a current to be applied to the primary transfer member is set to be 0 μA.

EXPERIMENT 2

Figure 5:
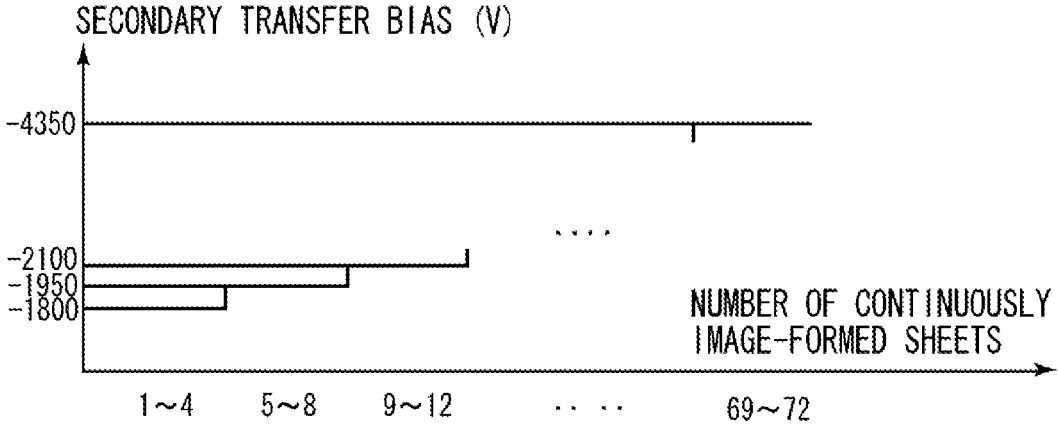
FIG. 5 illustrates changes of a voltage applied to a backup roller in a black single color mode.
Figure 6A:
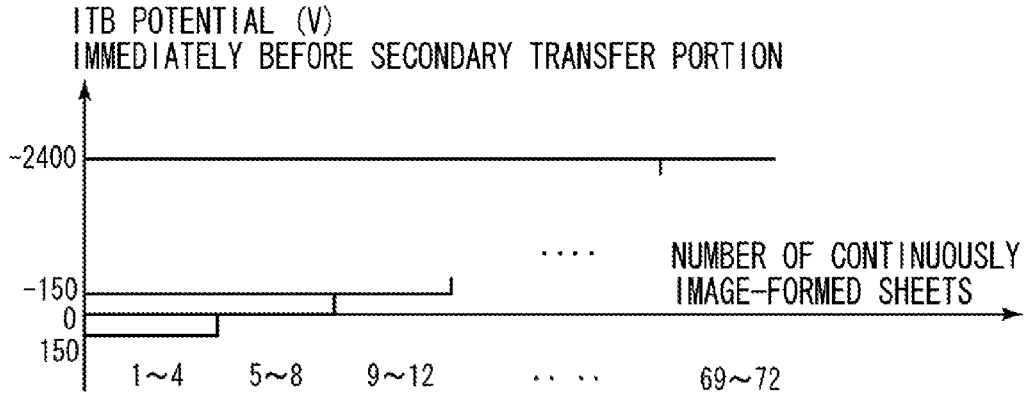
FIGS. 6A and 6B illustrate changes of the surface potential of the intermediate transfer belt in the black single color mode.
Figure 6B:
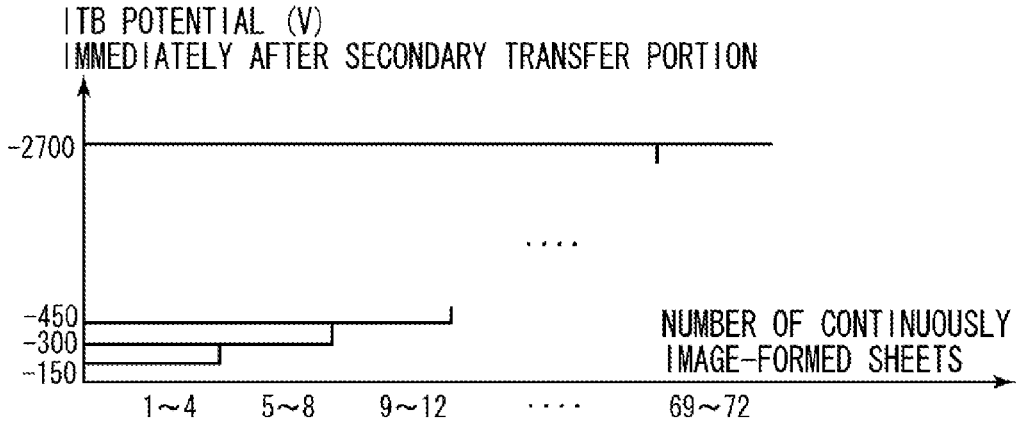

FIG. 5 illustrates a change of a voltage applied to the backup roller 34 in the black single color mode. FIGS. 6A and 6B illustrate changes of the surface potential of the intermediate transfer belt 30 in the black single color mode.

FIG. 5 illustrates, when continuous image formation is performed on an A4 recording material in the black single color mode, a change of a secondary transfer voltage output from the secondary transfer power source D2 to the backup roller 34. FIG. 6A illustrates a change of the surface potential of the intermediate transfer belt 30 measured by a surface electrometer disposed in a position adjacent to the entrance of the secondary transfer portion T2. FIG. 6B illustrates a change of the surface potential of the intermediate transfer belt 30 measured by a surface electrometer disposed in a position adjacent to the exit of the secondary transfer portion T2.

In the black single mode, the control unit 80 sets the transfer currents 0 μA to the power sources DY, DM, and DC. Primary transfer voltages applied to the primary transfer rollers 22Y, 22M, and 22C are controlled to the voltages equal to the surface potential of the abutted intermediate transfer belt 30. Thus, in the primary transfer portions TY, TM, and TC, no charge-up occurs, and no electrically discharging is needed.

In the black single color mode, since no toner images of other colors pass through the primary transfer unit TK, an optimal primary transfer current 1TrI can be set for only a black toner image. Consequently, the control unit 80 sets a primary transfer current 1TrI (30 μA) in the primary transfer power source DK to control a primary transfer voltage to keep a constant current.

As illustrated in FIG. 5, a secondary transfer voltage applied to the backup roller 34 gradually increases by −150 V, for example, the voltage is at about −1800 V during the image formation of 1st to 4th sheets, at about −1950V during the image formation of 5th to 8th sheets, and about −2100 V during the image formation of 9th to 12th sheets. That is because the intermediate transfer belt makes almost one rotation for every four A4-size image sheets to charge up −150 V, thereby increasing a secondary transfer voltage (absolute value) to obtain a secondary transfer current 2TrI (60 μA).

As illustrated in FIG. 6A, a surface potential of the intermediate transfer belt 30 in a position immediately before entering the secondary transfer portion T2 is about 150 V during the image formation of 1st to 4th sheets. That is because the intermediate transfer belt 30 is brought into contact with the primary transfer roller 22K to be charged by 150 V during its passage through the primary transfer portion TK.

As illustrated in FIG. 6B, a surface potential of the intermediate transfer belt 30 in a position immediately after passing through the secondary transfer portion T2 is about −150 V during the image formation of 1st to 4th sheets. That is because the intermediate transfer belt 30 is brought into contact with the backup roller 34 to be charged by −300 V during its passage through the secondary transfer portion T2, consequently the subtracted residual potential is −150 V.

Thus, according to Experiment 2, when continuous image formation is carried out on an A4 recording material in the black single color mode, for each rotation of the intermediate transfer belt 30, the intermediate transfer belt 30 is charged up in a minus direction to lower its surface potential by 150 V.

As illustrated in FIG. 5, when the continuous image formation is further continued, during the image formation of 69th to 72nd sheets, a secondary transfer voltage applied to the backup roller 34 increases to −4350 V.

Thus, when the intermediate transfer belt 30 is rotated one round to perform the image formation of 73rd to 76th sheets, an absolute value of a secondary transfer voltage to be applied to the backup roller 34 reaches the upper limit value of 4500 V. This situation can possibly occur after execution of the single color image forming mode.

In this case, the secondary power source D2 can no longer supply a necessary primary transfer voltage due to a capacity inadequacy of a high-voltage power supply, thus increasing a possibility of the occurrence of an image failure, such as density fluctuation or a shock image, caused by a transfer failure. In the backup roller 34 to which an abnormal high voltage is applied, a possibility of abnormal discharging to the members therearound or a current leakage phenomenon increases.

As illustrated in FIG. 6B, during the image formation of 69th to 72nd sheets, a surface potential of the intermediate transfer belt 30 in a position immediately after passing through the secondary transfer portion T2 is −2700 V.

Thus, according to the first exemplary embodiment, as illustrated in FIG. 2, the surface potential sensor 41 is disposed to detect the surface potential of the intermediate transfer belt 30. The control unit 80 interrupts the continuous image formation when a detection result by the surface potential sensor 41 becomes lower than a predetermined potential −2600 V as a second voltage, and electrically discharges the intermediate transfer belt 30 by the primary transfer portions TY, TM, TC, and TK. An absolute value of the predetermined potential is 2600 V. The surface potential of the intermediate transfer member has the same polarity as the charged polarity of a toner image. Thus, a current to be applied to the primary transfer member is set to be 0 μA.

Figure 8A:
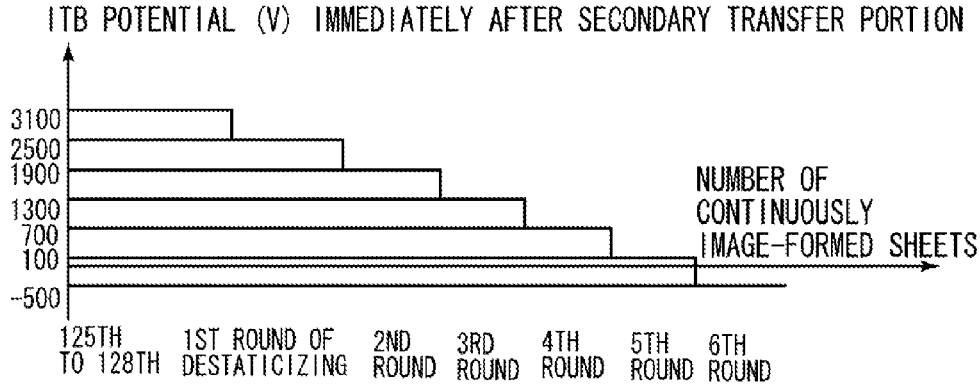
FIGS. 8A to 8C illustrate electrically discharging control when the surface potential exceeds 3000 V.
Figure 8B:
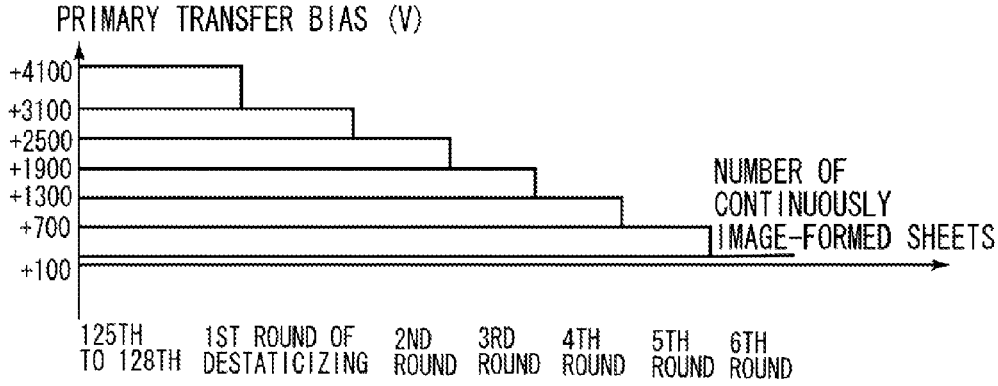
Figure 8C:
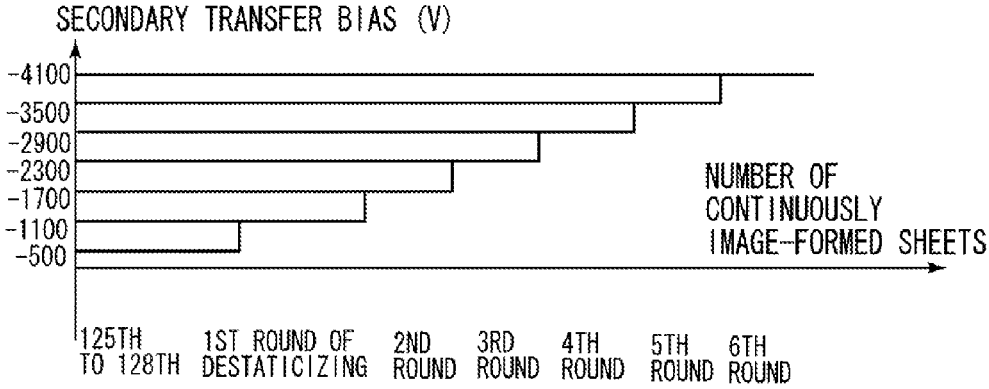
Figure 9A:
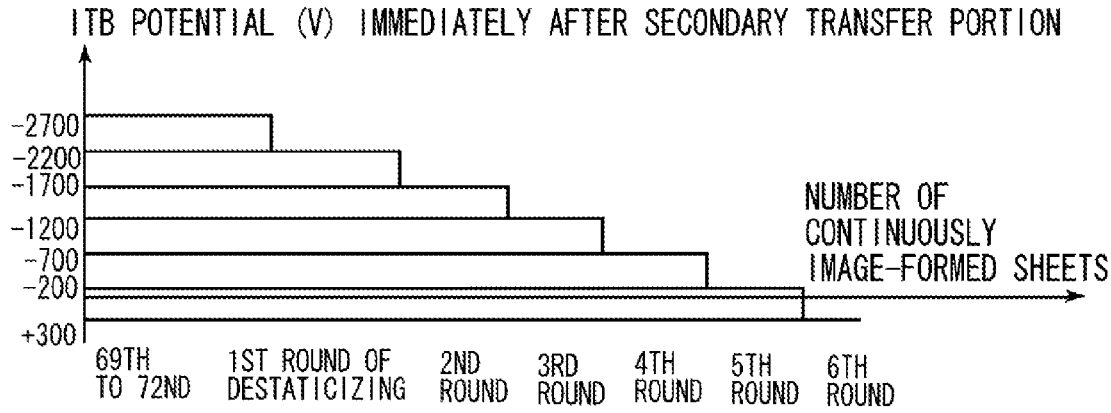
FIGS. 9A to 9C illustrate electrically discharging control when the surface potential drops below −2600 V.
Figure 9B:
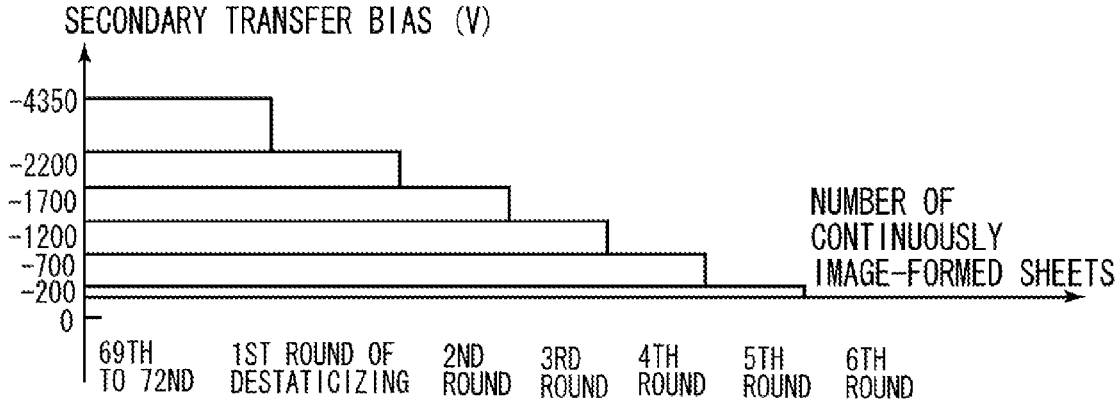
Figure 9C:
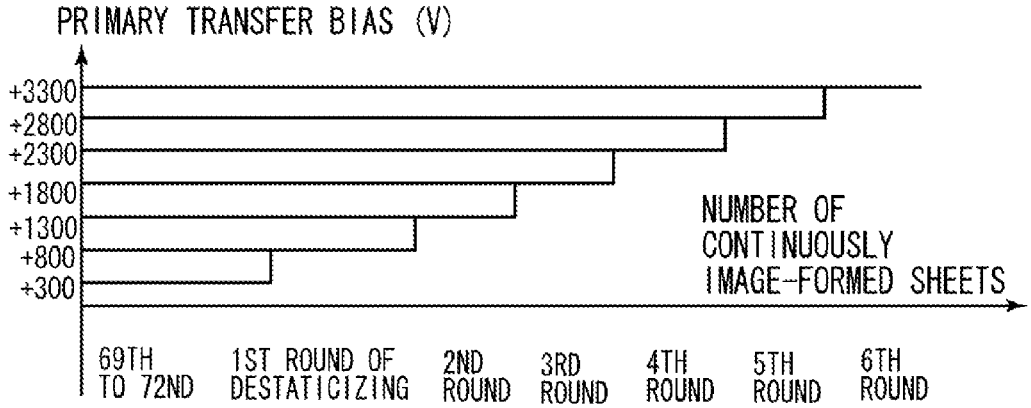

FIG. 7 is a flowchart of electrically discharging control according to the first exemplary embodiment. FIGS. 8A to 8C illustrate electrically discharging control when a surface potential exceeds 3000 V. FIGS. 9A to 9C illustrate electrically discharging control when a surface potential drops below −2600 V.

In this case, the control unit 80 includes functions of an execution unit which can perform a first process of electrically discharging the intermediate transfer member by applying a preset voltage of a first polarity from a first voltage application unit (first power source) to the primary transfer member, and a second process of electrically discharging the intermediate transfer member by applying a preset voltage of a second polarity from a second voltage application unit (second power source) to the secondary transfer member. The control unit 80 further includes a selection unit for selecting the process to be executed according to a charged state of the intermediate transfer member after the secondary transfer.

Referring to FIG. 2 and FIG. 7, in step S10, the control unit 80 starts the driving of a motor M1, when a job is input, to start pre-rotation of the intermediate transfer belt 30. In step S11, the control unit 80 reads an output of the surface potential sensor 41. A surface potential of the intermediate transfer belt 30 relates to a charged state of the intermediate transfer belt 30.

The control unit 80 performs continuous image formation (S300) when a surface potential does not exceed 3000 V (NO in step S12), nor drops below −2600 V (NO in step S22).

In step S300, the control unit 80 determines currents to be applied to the primary and secondary transfer members during electrically discharging according to an image forming mode. In the case of the full-color mode where a plurality of colors are superimposed (YES in step S18), as described above, in steps S19 and S20, the control unit 80 sets a primary transfer current to be 20 μA and a secondary transfer current to be 60 μμA.

In the case of the black single color mode in which the primary transfer is carried out once (NO in step S18), as described above, in steps S29 and S30, the control unit 80 sets a primary transfer current to be 30 μA and a secondary transfer current to be 60 μA.

Then, in steps S11 to S31, the control unit 80 continues the continuous image formation until the job is completed (YES in step S32).

However, when the surface potential exceeds 3000 V in the continuous image formation of the full-color mode (YES in step S12), then in step S100, the control unit 80 performs electrically discharging at the secondary transfer portion T2.

In step S13, the control unit 80 interrupts the continuous image formation. In steps S14 and S15, the control unit 80 sets a primary transfer current, which is an example of a primary constant current, to be 0 μA and a secondary transfer current, which is an example of a secondary constant current, to be 120 μA. In step S16, the control unit 80 reads an output of the surface potential sensor 41. Then, the control unit 80 continues idling of the intermediate transfer belt 30 until the surface potential drops below 0 V to complete the electrically discharging (NO in step S17).

As illustrated in FIG. 8A, since the continuous image formation of the full-color mode has been carried out on an A4-size recording material, and the surface potential has exceeded 3000 V during the image formation of 125th to 128th sheets, the control unit 80 starts electrically discharging at the secondary transfer portion T2. The intermediate transfer belt 30 is electrically discharged by 600 V for each time when it passes through the secondary transfer portion T2. Consequently, the surface potential of the intermediate transfer belt 30 in a position immediately after passing through the secondary transfer portion T2 drops by 600 V for each rotation.

As illustrated in FIG. 8B, at the primary transfer portion TY, the control unit 80 performs constant current control for the power source DY to set a primary transfer current 1TrI to be 0 μA. Thus, a voltage equal to the surface potential of the intermediate transfer belt 30 is continuously applied to the primary transfer roller 22Y. Therefore, the primary transfer portions TY, TM, TC, and TK perform neither charge-up nor electrically discharging on the intermediate transfer belt 30.

As illustrated in FIG. 8C, at the secondary transfer portion T2, the control unit 80 performs constant current control for the secondary transfer power source D2 to set a secondary transfer current 2TrI to be 120 μA. Thus, a voltage −1100 V is applied to the backup roller 34 at the 1st round of electrically discharging. With a progress of the electrically discharging, a voltage necessary for removing 120 μA from the intermediate transfer belt 30 rises in a minus direction. Consequently, a secondary transfer voltage rises by 600 V in a minus direction for each rotation of the intermediate transfer belt 30.

As illustrated in FIG. 8A, at the 6th rotation (6th round) of the intermediate transfer belt 30, the control unit 80 performs electrically discharging by increasing the secondary transfer voltage to −4100 V to remove 120 μA from the intermediate transfer belt 30, thus causing the surface potential to drop below 0 V. Then, the control unit 80 resumes the continuous image formation of the full-color mode from the 129th sheet.

When the surface potential drops below −2600 V in the continuous image formation in the black single color mode (YES in step S22), then in step S200, the control unit 80 performs electrically discharging at the primary transfer portion TK.

In step S23, the control unit 80 interrupts the continuous image formation. In step S24, the control unit 80 sets the primary transfer current, at the primary transfer portion TK, to be 100 μA. In step S25, the control unit 80 sets the secondary transfer current to be 0 μA. In step S26, the control unit 80 reads an output of the surface potential sensor 41. Then, the control unit 80 continues idling of the intermediate transfer belt 30 until the surface potential drops to 0 V or below 0 V to complete the electrically discharging (NO in step S27). As described above, primary transfer currents 1TrI of the primary transfer portions TY, TM, and TC are maintained at 0 μA.

After completion of the electrically discharging (YES in steps S17 and S27), then in step S300, the control unit 80 resumes the continuous image formation.

As illustrated in FIG. 9A, since the continuous image formation of the black single color mode has been carried out on an A4-size recording material, and the surface potential has dropped below −2600 V during the image formation of 69th to 72nd sheets, the control unit 80 starts electrically discharging at the secondary transfer portion T2. The intermediate transfer belt 30 is electrically discharged by −500 V for each time when it passes through the secondary transfer portion T2. Consequently, the surface potential of the intermediate transfer belt 30 in a position immediately after passing through the secondary transfer portion T2 rises by 500 V for each rotation.

As illustrated in FIG. 9B, at the secondary transfer portion T2, the control unit 80 performs constant current control for the secondary transfer power source D2 to set a secondary transfer current 2TrI to be 0 μA. Thus, a voltage equal to the surface potential of the intermediate transfer belt 30 is continuously applied to the backup roller 34. Therefore, at the secondary transfer portion T2, the control unit 80 carries out neither charging-up nor electrically discharging for the intermediate transfer belt 30.

As illustrated in FIG. 9C, at the primary transfer portion TK, the control unit 80 performs constant current control for the primary transfer power source DK to set a primary transfer current 1TrI to be 100 μA. Thus, a voltage 800 V is applied to the primary transfer roller 22K at the 1st round of electrically discharging. With a progress of electrically discharging, a voltage needed for supplying 100 μA to the intermediate transfer belt 30 rises. Consequently, the primary transfer voltage rises by 500 V for each rotation of the intermediate transfer belt 30.

As illustrated in FIG. 9A, at the 6th rotation (6th round) of the intermediate transfer belt 30, the control unit 80 performs electrically discharging by increasing the primary transfer voltage to 3300 V to supply 100 μA to the intermediate transfer belt 30, thus causing the surface potential to exceed 0 V. Then, the control unit 80 resumes the continuous image formation of the black single color mode from the 73rd sheet.

According to the first exemplary embodiment, when the intermediate transfer belt 30 is charged in a plus direction caused by continuous image formation in the full-color mode, if a detection result by the surface potential sensor 41 exceeds a threshold potential (3000 V), the electrically discharging mode is carried out at the secondary transfer portion T2. Thus, it is prevented that necessary primary transfer voltages is not applicable due to the capacity inadequacy of the high-voltage power sources DY, DM, DC. As a result, an image failure, such as color fluctuation or color misregistration, due to a transfer failure can be prevented. Moreover, problems such as a current leakage phenomenon to the members adjacent to the primary transfer rollers 22Y, 22M, 22C, and 22K can be prevented.

When the intermediate transfer belt 30 is charged in a minus direction caused by the continuous image formation of the black single color mode, if a detection result by the surface potential sensor 41 drops below a threshold potential (−2600 V), the electrically discharging mode is carried out at the primary transfer portion TK. Thus, it is prevented that a necessary secondary transfer voltage is not applicable due to a capacity inadequacy of a high-voltage power supply of the secondary transfer power source D2. Consequently, a failure, such as density fluctuation or a shock image, due to a transfer failure can be prevented. Moreover, problems such as a current leakage phenomenon to the members adjacent to the backup roller 34 can be prevented.

According to the first exemplary embodiment, in whichever direction, plus or minus, the intermediate transfer belt 30 is charged during the continuous image formation, the intermediate transfer belt 30 can be electrically discharged. The apparatus can be reduced in cost and size, because any dedicated electrically discharging mechanism is not needed.

Figure 10:
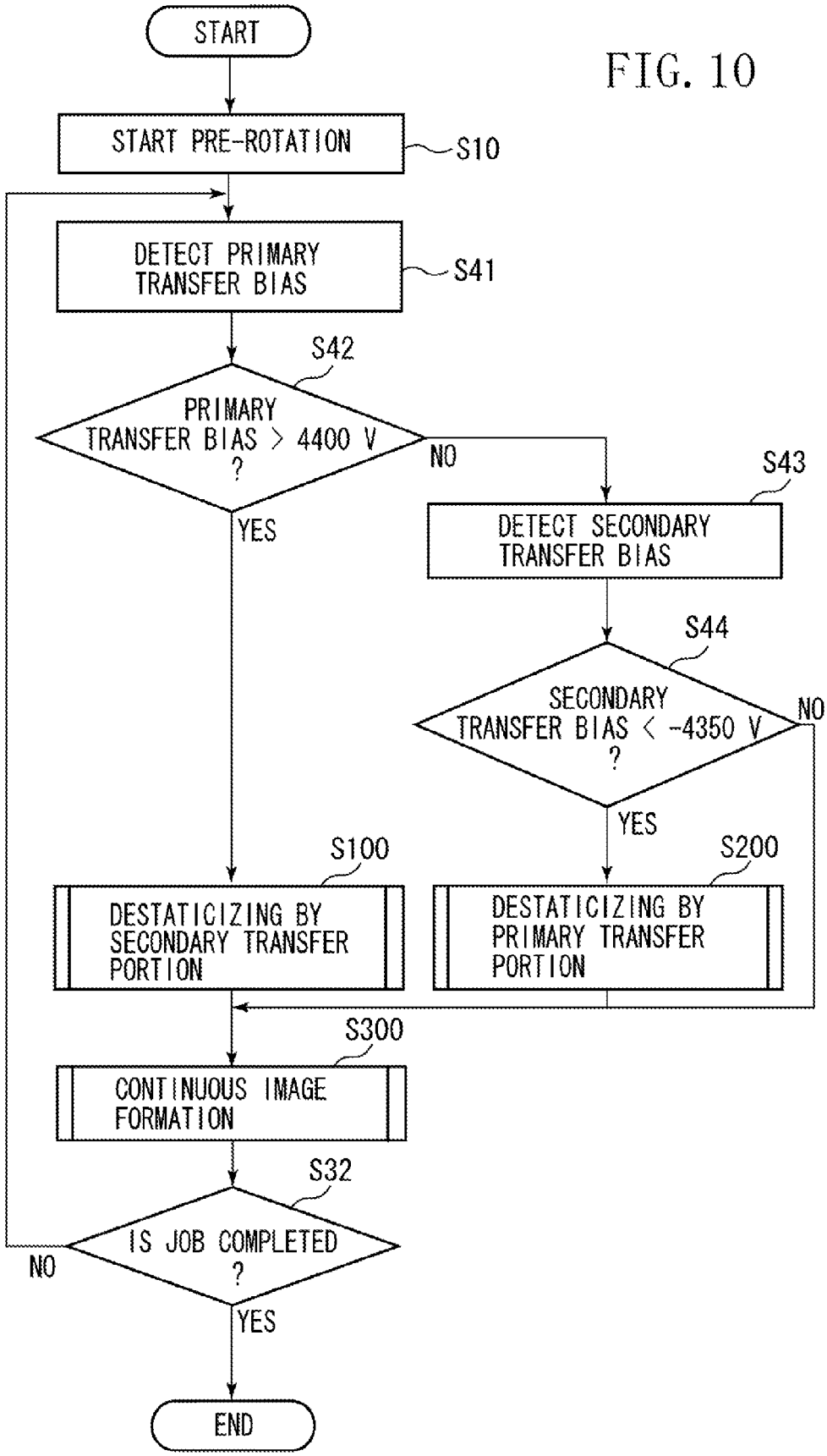
FIG. 10 is a flowchart of electrically discharging control according to a second exemplary embodiment of the present invention.

FIG. 10 is a flowchart of electrically discharging control according to a second exemplary embodiment of the present invention.

The second exemplary embodiment uses the image forming apparatus 100 of the first exemplary embodiment described above with reference to FIGS. 1 to 6A and 6B, and only a part of the electrically discharging control illustrated in FIG. 7 is changed. Thus, reference numerals similar to those of the first embodiment regarding the aforementioned control of the first exemplary embodiment are employed to avoid repeated description.

Referring to FIG. 2, as illustrated in FIG. 10, in a similar way as the first exemplary embodiment, the control unit 80 performs electrically discharging at the secondary transfer portion T2 in step S100, electrically discharging at the primary transfer portions TY, TM, TC, and TK in step S200, and continuous image formation in step S300.

In the case of the first exemplary embodiment, the control unit 80 starts the electrically discharging mode by using the surface potential of the intermediate transfer belt 30 as a trigger. In the case of the second exemplary embodiment, however, the control unit 80 starts the electrically discharging mode by using primary and secondary transfer voltages (primary and secondary transfer biases) as triggers. The primary and secondary transfer voltages under constant-current control have a relation with the charged state of the intermediate transfer belt 30.

A prescribed value of the primary transfer voltage which triggers the electrically discharging start is set to be 4400 V based on a result of Experiment 1, while a prescribed value of the secondary transfer voltage is set to be −4350 V based on a result of Experiment 2.

In step S41, the control unit 80 detects the primary transfer voltage. If the primary transfer voltage exceeds 4400 V (YES in step S42), then in step S100, the control unit 80 starts the electrically discharging mode at the secondary transfer portion T2.

In step S43, the control unit 80 detects the secondary transfer voltage. If the secondary transfer voltage drops below −4350 V (YES in step S44), then in step S200, the control unit 80 starts the electrically discharging mode at the primary transfer portion TK.

The control unit 80 can start electrically discharging by detecting a disability of at least one of power sources DY, DM, DC, DK, and D2 to supply a prescribed constant current caused by charging-up of the intermediate transfer belt 30. The control unit 80 can also start electrically discharging by detecting fluctuation of an output voltage or an electric wave noise caused by abnormal discharging.

Figure 11:
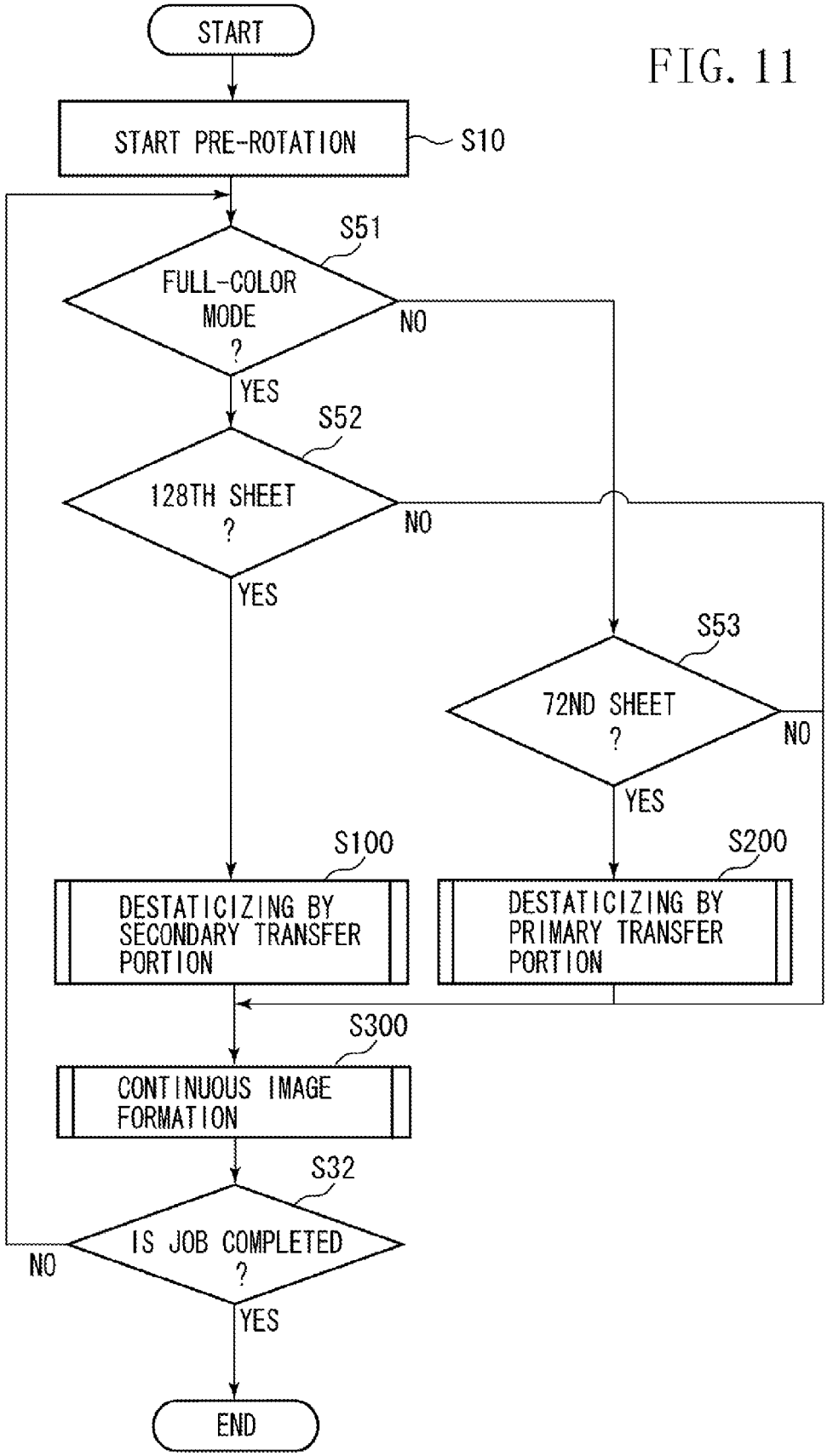
FIG. 11 is a flowchart of electrically discharging control according to a third exemplary embodiment of the present invention.

FIG. 11 is a flowchart of electrically discharging control according to a third exemplary embodiment of the present invention.

The third exemplary embodiment uses the image forming apparatus 100 of the first exemplary embodiment described above with reference to FIGS. 1 to 6A and 6B, and only a part of the electrically discharging control illustrated in FIG. 10 is changed.

Thus, regarding the aforementioned control of the first and second exemplary embodiments, reference numerals similar to those of the first and second exemplary embodiments are employed to avoid repeated description.

Referring to FIG. 2, as illustrated in FIG. 11, in a similar way as the first exemplary embodiment, the control unit 80 performs electrically discharging at the secondary transfer portion T2 in step S100, electrically discharging at the primary transfer portion T1 in step S200, and continuous image formation in step S300.

In the case of the first exemplary embodiment, the control unit 80 starts the electrically discharging mode by using the surface potential of the intermediate transfer belt 30 as a trigger. In the case of the third exemplary embodiment, however, the control unit 80 starts the electrically discharging mode by using a predetermined number of continuously image-formed sheets in a full-color mode or a black single color mode as a trigger. The number of continuously image-formed sheets has a relation with a charged state of the intermediate transfer belt 30.

A prescribed value in the full-color mode, which is a trigger of a electrically discharging start, is set to be 128 sheets based on a result of Experiment 1, while a prescribed value in the black single color mode is set to be 72 sheets based on a result of Experiment 2.

In the case of the full-color mode (YES in step S51), if the number of continuously image-formed sheets reaches 128 sheets, as converted into A4-size recording materials (YES in step S52), then in step S100, the control unit 80 starts the electrically discharging mode at the secondary transfer portion T2.

In the case of the black single color mode (NO in step S51, if the number of continuously image-formed sheets reaches 72 sheets, as converted into A4-size recording material (YES in step S53), then in step S200, the control unit 80 starts the electrically discharging mode at the primary transfer portion TK.

The number of continuously image-formed sheets as a prescribed value can be increased or decreased according to an output of the temperature humidity sensor 65.

Figure 12:
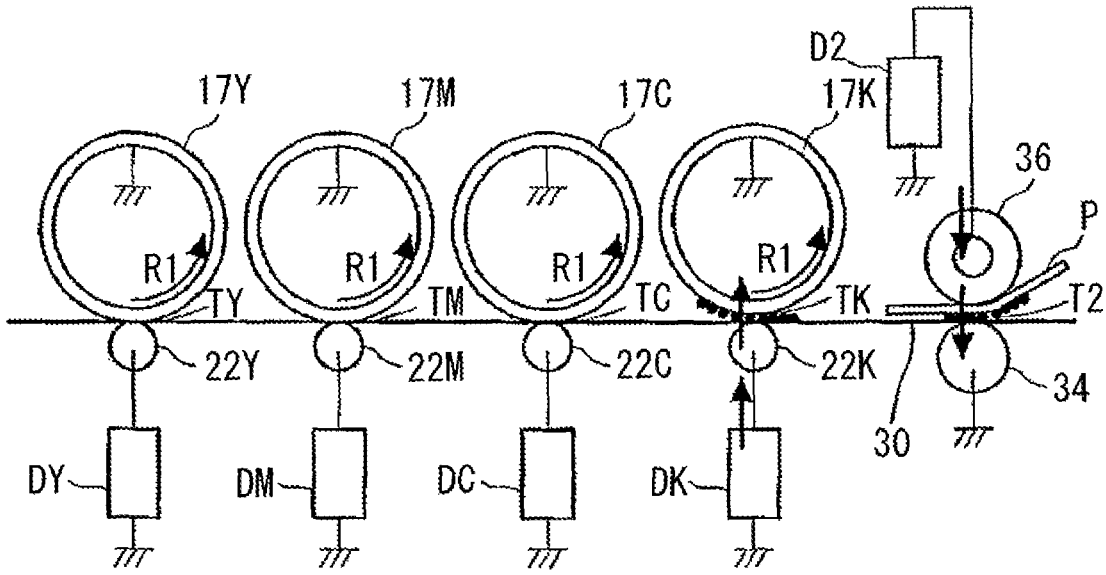
FIG. 12 illustrates electrically discharging control in an image forming apparatus according to a fourth exemplary embodiment of the present invention.

FIG. 12 illustrates electrically discharging control in an image forming apparatus according to a fourth exemplary embodiment of the present invention.

As illustrated in FIG. 2, in the case of the first exemplary embodiment, the secondary transfer roller 36, which is in contact with the recording material P, is connected to the ground potential, and the secondary transfer power source D2 having an output voltage of negative polarity is connected to the backup roller 34, which is in contact with the inner surface of the intermediate transfer belt 30.

As illustrated in FIG. 12, according to the fourth exemplary embodiment, the backup roller 34, which is in contact with the inner surface of the intermediate transfer belt 30, is connected to the ground potential, and the secondary transfer power source D2 having an output voltage of positive polarity is connected to the secondary transfer roller 36, which is in contact with the recording material P.

In this case, the intermediate transfer belt 30 can be electrically discharged by using the primary transfer portions TY, TM, TC, and TK and the secondary transfer portion T2 complementarily.

In the full-color mode, the intermediate transfer belt 30 charged at the primary transfer portions TY, TM, TC, and TK can be electrically discharged by forcibly supplying a reverse direction current at the secondary transfer portion T2.

In the black mode, the intermediate transfer belt 30 charged at the secondary transfer portion T2 can be electrically discharged by forcibly supplying a reverse direction current at the primary transfer portion.

As described above, according to the fourth exemplary embodiment of the present invention, charging-up of the intermediate transfer member can be suppressed without adding any electrically discharging device dedicated to electrically discharging of the intermediate transfer member after secondary transfer.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-303597 filed Nov. 22, 2007, which is hereby incorporated by reference herein in its entirety.

What is claimed is:

1. An image forming apparatus comprising:

an image bearing member;

an intermediate transfer member configured to bear a toner image transferred from the image bearing member;

a primary transfer member configured to primary-transfer the toner image on the image bearing member to the intermediate transfer member;

a first voltage application unit configured to apply to the primary transfer member a predetermined voltage of a first polarity for transferring the toner image on the image bearing member to the intermediate transfer member;

a secondary transfer member configured to transfer the toner image on the intermediate transfer member to a recording material;

a second voltage application unit configured to apply to the secondary transfer member a predetermined voltage of a second polarity for transferring the toner image on the intermediate transfer material to the recording material;

an execution unit configured to execute a first discharging process of electrically discharging the intermediate transfer member by applying the voltage of the first polarity from the first voltage application unit to the primary transfer member, and a second discharging process of electrically discharging the intermediate transfer member by applying the voltage of the second polarity from the second voltage application unit to the secondary transfer member; and a selection unit configured to select a discharging process according to a charged state of the intermediate transfer member after secondary transfer.

2. The image forming apparatus according to claim 1, wherein the selection unit selects the first discharging process when a surface potential of the intermediate transfer member after secondary transfer has the same polarity as a charged polarity of the toner image.

3. The image forming apparatus according to claim 1, wherein the selection unit selects the second discharging process when a surface potential of the intermediate transfer member after secondary transfer has a polarity opposite a charged polarity of the toner image.

4. The image forming apparatus according to claim 1, wherein the execution unit executes one of the first and second discharging processes when an absolute value of a surface potential of the intermediate transfer member after secondary transfer reaches a predetermined potential.

5. The image forming apparatus according to claim 1, wherein a surface resistivity of the intermediate transfer member is equal to $1\times10^{13}$ Ω/sq or more.

6. The image forming apparatus according to claim 1, wherein the first polarity of the voltage applied from the first voltage application unit is opposite to a charged polarity of the toner image.

* * * * *